United States Patent [19]

Cowlin et al.

[11] 4,410,091

[45] Oct. 18, 1983

[54] ARTICLE SORTING APPARATUS AND METHOD

[75] Inventors: Robert M. Cowlin, Thorpeness near Leiston; Nigel C. Helsby, Maldon, both of England

[73] Assignee: Lockwood Graders (UK) Limited, Danbury, England

[21] Appl. No.: 262,771

[22] Filed: May 11, 1981

[30] Foreign Application Priority Data

May 14, 1980 [GB] United Kingdom ..... 8015940

[51] Int. Cl.[3] ..... B07C 3/14; B07C 5/36

[52] U.S. Cl. ..... 209/546; 209/705; 209/942

[58] Field of Search ..... 209/546, 552, 702, 703, 209/705, 938, 939, 942; 414/134, 135, 136; 358/96, 106

[56] References Cited

U.S. PATENT DOCUMENTS 3,917,069 11/1975 Alexander ..... 414/136 X
4,164,291 8/1979 Carlow ..... 209/942 X
4,184,598 1/1980 Cowlin et al. ..... 209/705
4,348,277 9/1982 Cowlin et al. ..... 209/939 X
4,351,437 9/1982 Long ..... 209/939 X

*Primary Examiner*—Robert B. Reeves
*Assistant Examiner*—Edward M. Wacyra
*Attorney, Agent, or Firm*—Cushman, Darby & Cushman

[57] ABSTRACT

Sorting apparatus, e.g. for root vegetables such as potatoes, comprises a roller table conveyor which has an inspection area onto which a video camera is directed. An operator uses a hand-held probe or wand incorporating a light source and provided with a pressure-sensitive switch in its tip. The switch is actuated by touching a selected article in the inspection area. The position of the wand as indicated by light is given in the video signals fed from the camera to a control circuit to which the switch is also connected. The control circuit also receives speed indicating signals from the conveyor and it provides control signals to operate a finger bank to selectively deflect those articles indicated by a touch of the wand. Provision may be made for a plurality of wands to be used at the same time, each wand having an individually modulated light.

27 Claims, 6 Drawing Figures

ARTICLE SORTING APPARATUS AND METHOD

The present invention relates to apparatus for and a method of sorting articles and has particular, but not exclusive, application to the sorting of root vegetables, for example, potatoes.

It is now common practice in potato harvesting to employ automatic means to separate potatoes from soil and stones and to grade the crop by size. However, quality selection (i.e. the removal of sub-standard potatoes from acceptable potatoes) is often not automated and still relies upon operators picking out sub-standard potatoes as the crop passes along an inspection table. This quality selection procedure is ineffecient in terms of labour deployment and is usually the speed-determining step in potato handling.

It has previously been proposed to improve operator efficiency by providing automatic removal means responsive to a position-indicating signal from a manually operable indicator. In this system, the indicator comprises an oscillating coil which is actuated when the indicator is pressed on a potato to be rejected and the position of the potato is indicated by a signal induced by an orthogonal array of coils disposed beneath the inspection table. Such a system has a number of inherent disadvantages, including the effect of dirt falling from potatoes onto the coils, and the need to align the potatoes carefully on the table relative to the array of coils because of lack of good resolution.

In our U.K. Patent Application No. 41940/76 (corresponding published U.S. Pat. No. 4,184,598), there is described an alternative system of generating a position-indicating signal for use in potato sorting which can be designed to eliminate, or at least reduce, the effects of dirt from the potatoes and the degree of potato alignment required on the inspection table, and to operate at a higher resolution than the known system described above. In this patent specification, a selector member comprises an elongate arm emitting a beam of light from one end thereof and pivotally mounted at the other end thereof on a reference frame by a swivel joint. A signal means is located at the upper, swivel joint end of the arm and generates electrical position-dependent signals defined by the angle of swivel of the arm. A manually operated trigger on a pistol grip holder is used to control the direction of the light beam onto a selected potato.

In operation the potatoes or other articles are conveyed past an operator who observes the potatoes directly and manoeuvres the pistol grip until the light beam is shining on a selected, reject potato. The trigger is then pulled and the appropriate position-indicating signal is supplied to a downstream deflector means which, after an appropriate delay, deflects the unwanted potato.

Although the apparatus described in the above Patent has considerable advantages over known systems, in terms of speed and accuracy of operation, operator comfort, and separation of electrical and mechanical components from the region of dirt and wear by the articles being sorted, there remain certain difficulties for the operator in having a substantial physical effort in the movement of the pistol grip and associated selector arm.

It is an object inter alia of the present invention to provide a sorting apparatus in which the difficulties set out above are reduced or removed. In addition to the sorting of potatoes, it will be appreciated that the system of the present invention has application to sorting other articles, especially but not exclusively other root vegetables and bulbs.

According to the present invention there is provided article sorting apparatus comprising conveying means for conveying articles to be sorted through an inspection area, camera means for viewing the inspection area, selection means for selecting an article present in the inspection area, the selection means including emitter means, and the camera means being sensitive to the output of the emitter means to generate signals representing the position of the emitter means in the field of view of the camera means, separating means for selectively separating articles, and control means for actuating the separating means in dependence upon signals generated by the camera means to effect selective separation of articles in response to article selection by an operator utilising the selection means in the inspection area.

The invention finds particular application where a plurality of articles to be sorted are present simultaneously in the inspection area and the selection means is arranged to select an article from the articles present in the inspection area. Conveniently the separating means comprises deflector means for selectively deflecting articles to achieve the required separation.

The emitter means may comprise source means for emitting the said output to which the camera means is sensitive by generating the output, or the emitter means may comprise reflector means for emitting the said output by reflection. The emitter means may comprise any suitable means for emitting the said output to which the camera means is sensitive, and may include for example emission by fluorescence or phosphorescence.

In preferred embodiments, the emitter means emits electromagnetic radiation (conveniently light in the visible range), either by generation of the radiation in the emitter means or by reflection of the radiation from an external source, or from ambient radiation. Thus conveniently the emitter means may comprise a light source such as a solid state or filamentary lamp. In other arrangements, the emitter means may comprise a reflector device such as is used in reflectors on motor vehicles, in which light is gathered over a wide angle and reflected in a narrow beam in a preferred direction. Alternatively the emitter means may include a member painted with a fluorescent paint, or even painted white or in a bright colour, provided that the lighting arrangements and background are such that the camera means is adequately sensitive to the reflected light from the painted area.

In accordance with a preferred aspect of the invention the selection means may comprise indicator means for indicating a location in the field of view of the camera means by moving the emitter means to or in the region of that location. Conveniently the emitter means output consists of an indication signal indicating the position of the location indicated by the indicator means. Conveniently the emitter means provides an output, and the camera means responds to the output, throughout the time that the emitter means is in the field of view of the camera means, and the selection means includes switch means for providing a trigger signal fed to the control means to inform the control means when the location being indicated by the indicator means is the location of the selected article. In alternative arrangements the emitter means may be actuated only when a location of a selected article is indicated, but the previously described arrangement is preferred. Thus conveniently the camera means tracks the location of the emitter means continuously, and a further trigger signal is fed to the control means when the location being indicated contains a selected object.

Preferably the indicator means comprises an indicator member which is used to indicate a selected location by pointing the indicator member towards such location. It is preferred that the indicator member incorporates the switch means as a part thereof, in which case it can conveniently comprise a switch responsive to pressure or touch of the indicator member on a selected article in the inspection area. Alternatively the switch means may be provided in the form of a manually operated switch which is spaced from the inspection area.

The indicator member may comprise a wand, probe or pointer-like device which is hand held and both the switch means and the light may be incorporated in the wand, preferably at the tip thereof.

The camera means preferably has a cyclic scanning arrangement whereby the instant of detection of an indication signal relative to a scanning cycle is a measure of the position of the emitter means in the field of view of the camera means. In embodiments of the invention, the camera means may comprise a television-type camera having a scanning arrangement of field and line scanning motions so that the position of the emitter means along one axis is indicated by the instant in time in a line scan period at which the signal is detected and the position of the emitter means along an axis orthogonal to the said axis is indicated by the time in a field scan cycle of the line in which signals therefrom are detected. By this means the x and y coordinates of the location of the indicator member within the inspection area can be derived.

In one convenient arrangement, the output of the camera means consists of a video signal representing a line and field scan of the image of the selection area. When for example the image of a light emitting device on the tip of a wand is scanned, the video output signal increases sharply and is above a reference threshold level. A strobe signal is then generated which latches counts accumulated by counters that are initiated by start of line scan and start of field scan pulses. These counts can be arranged to represent the required orthogonal coordinates.

Returning now to a more general consideration of preferred aspects of the present invention, it is particularly preferred that the control means is arranged to actuate the said deflector means in dependence upon first and second co-ordinate signals representative of first and second orthogonal co-ordinates of locations within the inspection area, the orthogonal co-ordinates being arranged with the first co-ordinate in a direction across the path of travel of the conveyor means at the inspection area and with the second co-ordinate in a direction aligned along the path of travel of the conveyor means at the inspection area. It is further preferred that the deflector means comprises an array of deflector devices arranged across the path of the conveyor means downstream of the inspection area, and drive means for driving selected deflector devices, the selection of deflector devices actuated being controlled in dependence upon the said first co-ordinate signals and the timing of operation of the deflector devices being controlled in dependence upon the said second co-ordinate signals.

In accordance with another preferred feature of the present invention, the deflector means are situated downstream of the inspection area relative to the movement of the conveyor means, and there are provided conveyor sensor means for producing and feeding to the control means signals dependent upon the speed of the conveyor means, the control means being arranged to control actuation of the deflector means at times related to the transient positions of selected articles at the time of selection and to the speed of movement of said articles from the inspection area to the deflector means. Conveniently such conveyor sensor means includes at least one optical sensor arranged to detect rotation of a sprocket wheel driving the conveyor means in motion.

There may be provided a plurality of selection means for operation by one or more operators, each selection means allowing selection of articles in the inspection area. By way of example two operators may position themselves on opposite sides of the inspection area. Conveniently they can each hold a wand in each of their hands thus enabling four wands to be utilised.

In order to distinguish the signals from individual indicator members where a plurality of such members are provided the radiation emitted from the emitter means associated with each member may be individually modulated. The modulation may be amplitude modulation although any other suitable modulation of the emitter can be provided. Another advantage of modulating the signal is that it enables the output from the emitter means to be distinguished from other bright objects in the field of view of the camera.

While an image of the inspection area as obtained from the camera means is not essential in carrying out the invention, it may be convenient to provide a monitor screen which has use in the alignment and positioning of the camera means.

The deflector means may comprise fingers for deflecting articles falling from the conveyor means, the fingers being actuable between two or more positions so as to direct the falling articles onto different conveyor belts or other receptacles. In the case of potatoes or other root vegetables or bulbs, the said fingers can be of a kind well known in themselves for separating produce from soils and stones using, for example, x-ray beams to distinguish the difference. Usually, the deflector means will be located downstream of the inspection area, and in such cases the signals controlling actuation of the deflector means will be processed in the control means in order to compensate for the time delay for the articles to pass from the indicated transient positions in the inspection area to the deflector means.

However it is to be appreciated that the deflector means may constitute means for deflecting selected, or unselected articles at substantially the same time that the articles are selected. In such case of course no time delay needs to be introduced which is related to the speed of conveying. One method of achieving such deflection is for example to provide beneath the conveyor means a bank of ejector rods which can be triggered to project upwardly through apertures in the conveyor means to strike, for example, unwanted articles and to propel such articles clear of the conveyor means. Such arrangements have previously been used in connection with sorting of potatoes from stones, where unwanted stones have been ejected in this manner. It is to be understood that the term deflector means includes not only means for deflecting articles through differing angles during travel of the articles, but also includes means for removing articles entirely from a conveying path. Indeed any separating means for effecting sorting of objects in response to the signals generated by the selection means may be used.

The conveying means preferably comprises a roller table over which the articles are conveyed in the inspection area. A roller table is a conveyor formed of a plurality of rotatable elongate members, known as rollers, connected together by, for example, side chains to form an endless array in which the rollers are spaced apart with their axes parallel and trasverse to the direction of translational movement. Articles are conveyed in transversely extending rows supported by adjacent pairs of rollers. The rollers are rotated over at least part of the endless conveyor path in order to rotate the articles conveyed thereon to evenly distribute the articles on the conveyor and/or to sequentially present the whole surface of the articles for inspection. However it is to be appreciated that the conveyor means may alternatively consist of a conveyor belt which may include ribs or other dividing portions for maintaining articles in predetermined positions, or in some cases may be a smooth conveyor belt.

There is also provided in accordance with the present invention a method of sorting articles comprising the steps of conveying articles to be sorted through an inspection area, viewing the inspection area with a camera means, indicating the position of a selected article in the inspection area by emitting from such position an emitted signal to which the camera means is sensitive, generating from the camera means signals representing information as to the said position indicated, and selectively operating on said articles in dependence upon said signals generated by the camera means.

As has been mentioned in connection with the apparatus according to the present invention, the invention finds particular application where the method includes the step of selecting an article from two or more articles which are present simultaneously in the inspection area. The method is also particularly applicable where the selective operation on the articles consists of separating selected and unselected articles by selective deflection of articles.

In accordance with a preferred form of the method according to the present invention, signals identifying a selected article are generated by generating first and second co-ordinate signals representative of first and second orthogonal co-ordinates of a location in the inspection area, the orthogonal co-ordinates being arranged with the first co-ordinate in a direction across the path of conveying of the articles at the inspection area and with the second co-ordinate in a direction aligned along the path of conveying of the articles at the inspection area. It is yet further preferred that the step of selectively separating articles comprises arranging an array of deflector devices across the path of the conveying of the articles downstream of the inspection area, and actuating selected deflector devices, the selection of deflector devices actuated being controlled in dependence upon the said first co-ordinate signals and the timing of operation of the deflector devices being controlled in dependence upon the said second co-ordinate signals.

In accordance with another preferred form of the method according to the present invention the method includes the step of generating conveyor sensing signals dependent upon the speed of conveying of the articles, the step of selectively separating articles comprising arranging the deflector means downstream of the inspection area, and the step of actuating the deflector means at times related to the transient positions of selected articles at the times of selection thereof and related to the speed of movement of said articles from the inspection area to the deflector means.

Embodiments of the invention will now be described by way of example with reference to the the accompanying drawings in which.

Figure 1:
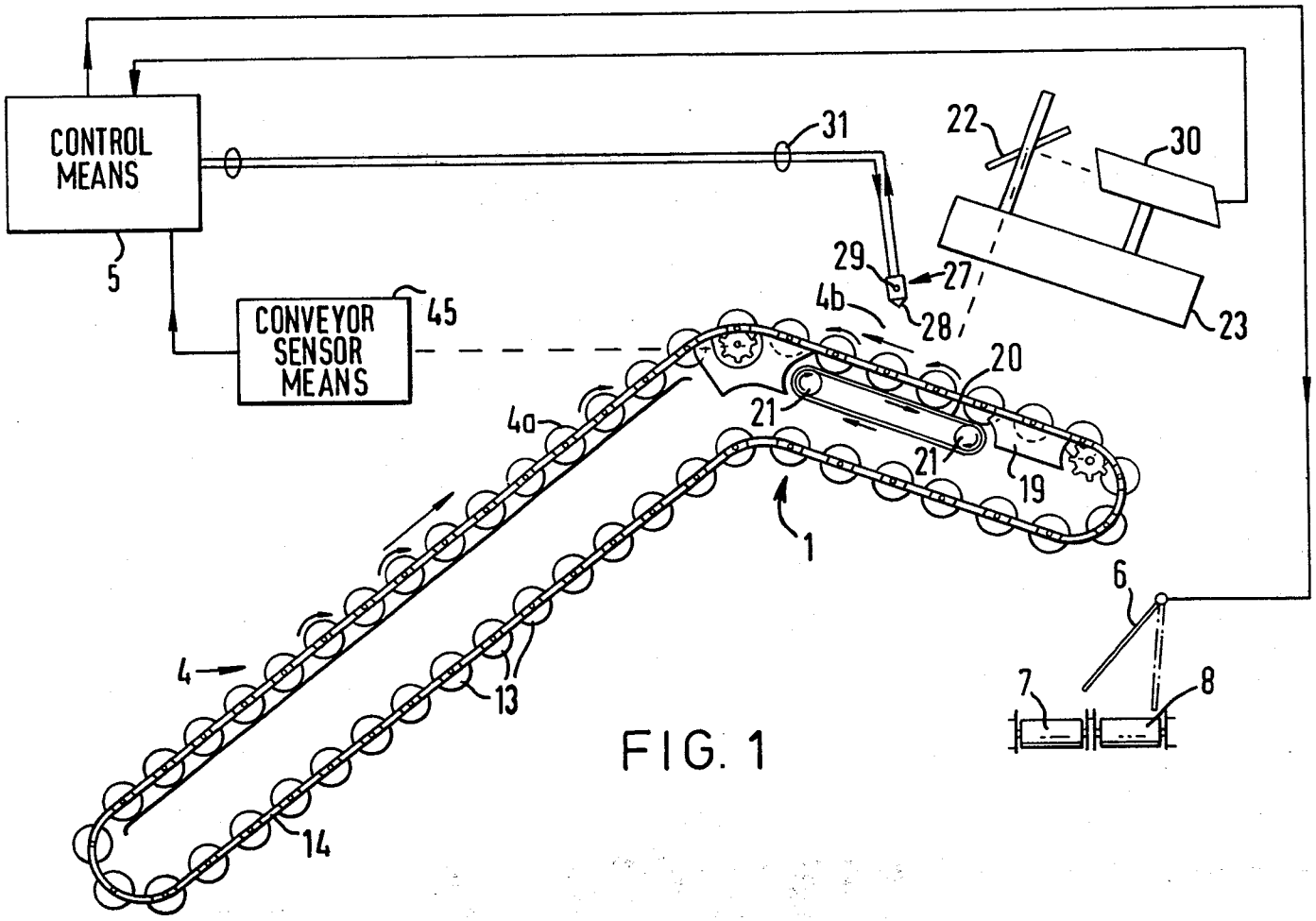
FIG. 1 is a schematic side view of a potato sorter in accordance with a preferred embodiment of the present invention.
Figure 2:
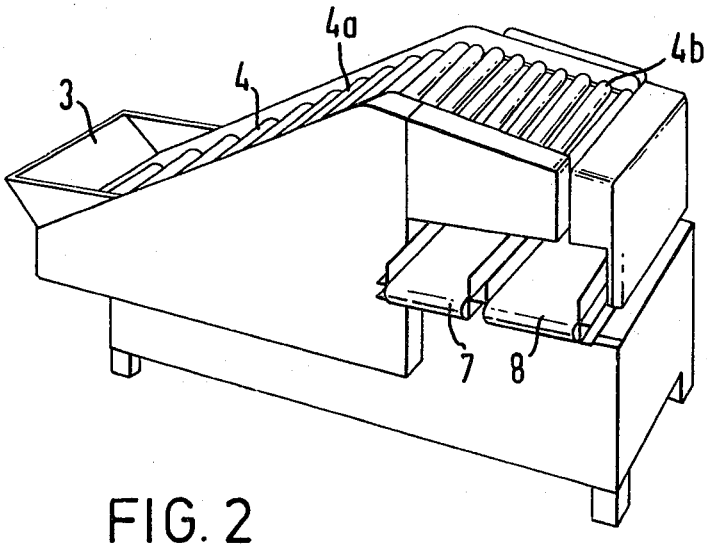
FIG. 2 is a perspective view of the roller table of the potato sorter shown diagrammatically in FIG. 1.
Figure 3:
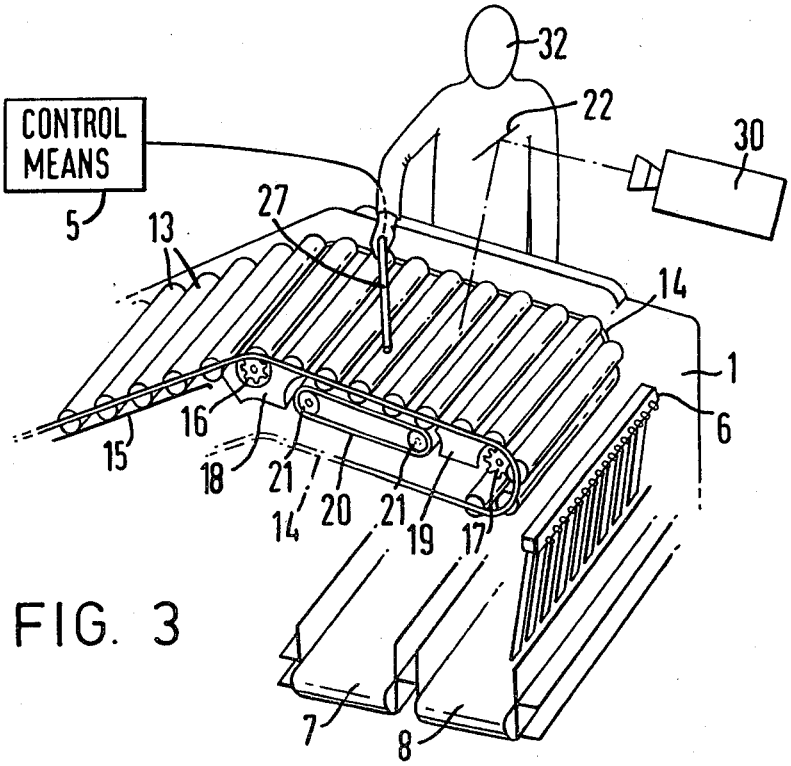
FIG. 3 is a view on a larger scale corresponding to FIG. 2 and showing part of the potato sorter with some casing and frame members omitted.

Referring firstly to FIGS. 1, 2 and 3 of the drawings, a potato sorting machine has a hopper 3 provided at the rear, input end of the machine to receive the potatoes from, for example, a pre-cleaner in which clods and stones have been separated from the potatoes. A roller table conveyor 4 conveys the potatoes from the hopper along an upwardly inclined path 4*a* to a slightly downwardly inclined inspection area 4*b* at the forward end of the machine. Mounted above the inspection area 4*b* is a video camera 30 secured to a fixed framework 23. The camera receives a visual image of the inspection area 4*b* by way of a mirror 22. Information as to the rate of movement of the conveyor 4 is detected by conveyor sensor means 45 and is fed to a control means 5 the function of which will be more fully explained hereafter.

An operator 32 indicates the position of a selected "reject" potato in the inspection area 4*b* by using a hand-held probe or wand 27 which is moved towards the location of the selected potato. Wand 27 has a pressure-sensitive switch or trigger 28 at its tip which is actuated by touching a selected potato, and feeds a trigger signal to control means 5.

Wand 27 is also provided with a small light source 29 and both the light source 29 and the switch 28 are connected to control means 5 by a flexible multi-core cable 31. Camera 30 is sensitive to the light output from source 29 and feeds to the control means 5 video signals containing information as to the position of light source 29. Actuation of the switch 28 informs the control means 5 that a reject potato is being indicated.

Control means 5 receives the following signals namely, video signals from camera 30, trigger signals from switch 28 and signals from conveyor sensor means 45. All these signals are processed in control means 5 to provide control signals to actuate appropriate fingers of a finger bank 6 at the required instants of time to deflect rejected articles on to a reject conveyor 7. In the absence of any signal from control means 5 the fingers direct the rejects on to a produce conveyor 8.

The roller table 4 and conveyors 7 and 8 are driven in conventional manner by chains and sprockets from a central motor (not shown). The finger bank is pneumatically operated in known manner by compressed air from an electrical compressor (not shown).

The roller table 4 comprises a plurality of right circular wooden rollers 13 rotatably mounted in an endless array with their axes parallel between two transversely spaced endless side chains 14 in known manner, for example as described in our pending U.K. Patent Application No. 41940/76, corresponding published U.S. Pat. No. 4,184,598. An endless belt 20 supported by spaced drive rollers 21 is located within the roller table so that the rollers 30 in the inspection area rest upon the upper flight of the belt 20. The belt is driven by the rollers 21 so that the upper flight moves in the same translational direction as the rollers 13 in contact therewith, and thereby cause the rollers to rotate in an anti-clockwise direction as viewed in the Figures. This condition is advantageous for distributing potatoes from the hopper 3 into transversely extending rows where they rest between adjacent pairs of rollers, and for allowing inspection of the potatoes.

Light signals from wand 27 and picked-up in camera 30 are processed in control means 5 to provide in effect the orthogonal x and y co-ordinates of the point of the inspection area selected by wand 27. The transverse position of a potato on a full roller table will not change substantially during passage from the point of indication to the forward discharge end of the table. However, there will be a time delay before it reaches the forward end and therefore the signals derived from the wand are processed in the control means in dependence upon the translational speed of the roller table to compensate for this time delay. Appropriate circuitry for providing this time delay will be readily apparent to those familiar with electrical control logic.

The processed signal from the control means 5 is fed to the finger bank 6 provided at the forward end of the machine. The finger bank 6 is known in itself for use in, for example, separating clods and stones from potatoes by X-ray pre-cleaners and therefore will not be described in detail. Each finger of the bank is movable independently of the remaining fingers in response to a respective processed signal from the control means 5. If desired, each finger can be arranged to operate with an adjacent finger depending upon the transverse position of the reject potato on the inspection table. In their normal position, the fingers are inclined downwardly to direct potatoes onto the produce conveyor 8. When actuated to reject a potato a finger is caused or allowed to pivot by a small amount in a clockwise direction as viewed in the Figures to deflect reject potatoes onto the reject conveyor 7.

In operation, an operator observes the potatoes as they pass through inspection area **4*b* and moves wand 27 to point the probe at a reject potato. When wand 27 touches a reject potato, the trigger 28 is actuated thereby causing a trigger signal to be fed to the control means 5 by the wand. The signal picked up in camera 30 is processed in control means 5 which provides control signals to the finger bank to move the appropriate finger or fingers to deflect the reject potato onto the reject conveyor 7** when the potato falls from the end of the roller table.

Figure 4:
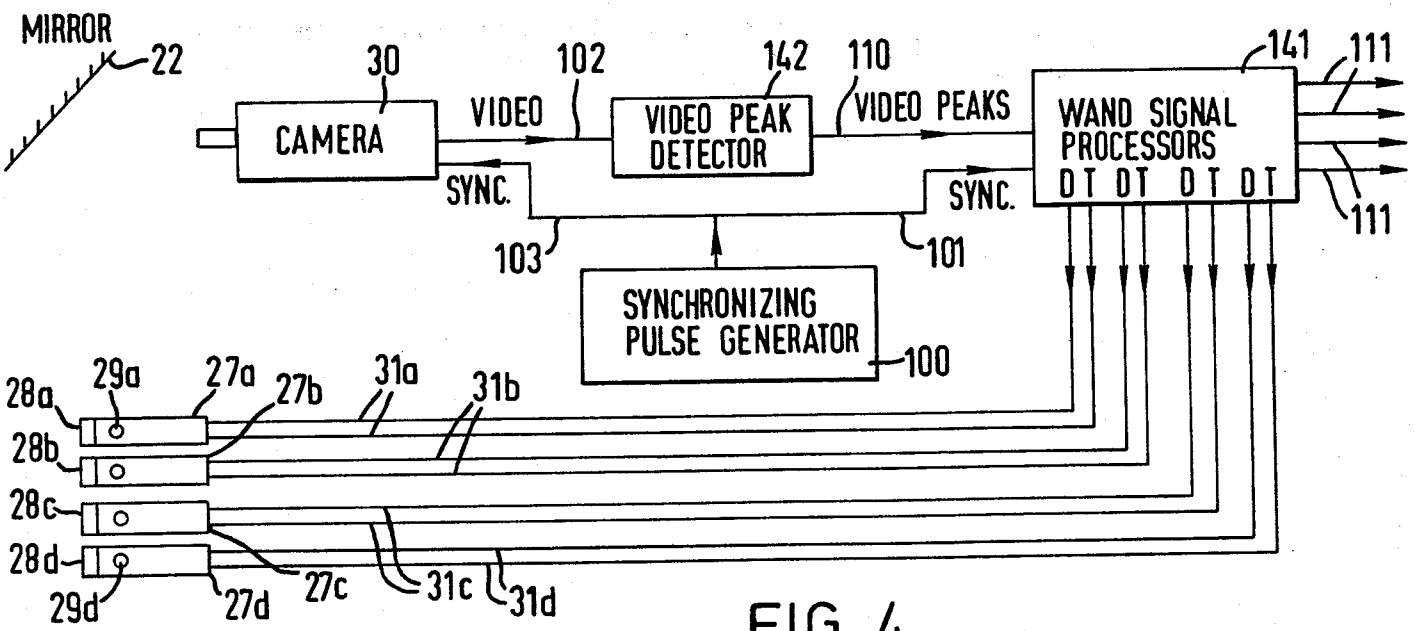
FIG. 4 is a block circuit diagram of part of the control means and certain associated elements shown in FIG. 1.

Certain features of the embodiment of the invention that has been described with reference to FIGS. 1, 2 and 3 will now be described with reference to FIG. 4. In FIG. 4 there are shown some of the elements which form part of control means 5 as well as the camera 30 and a plurality of wands such as the wand 27 of FIG. 1. However, whereas in FIGS. 1 and 3 only one wand has been shown it is possible to provide a plurality of wands and four such wands are shown in FIG. 4 these being referenced by the same reference numerals as used in FIG. 1 but with the addition of an appropriate suffix letter. Thus wand **27*a* has a pressure-sensitive switch 28*a* at its tip and includes a light source 29*a* to indicate its position. Switch 28*a* is operated, for example by touching a selected article. Wand 27*a* is connected by a flexible cable 31*a* to a wand signal processor 141 which forms part of the control means 5. The other wands shown in FIG. 4, namely wands 27*b*, 27*c* and 27*d*, are all similar to wand 27*a* and are connected to the wand signal processor 141 through their individual flexible cables 31*b*, 31*c* and 31*d*.** Each flexible cable includes connections for the switch in its wand, and supply leads to energise the light source of its wand.

Also forming part of control means 5 is a synchronising pulse generator 100 and a video peak detector 142. Pulse generator 100 provides synchronising pulses for camera 30 along line 103 and for the signal processor 141 along line 101. The video signal output from camera 30 is passed along line 102 to video peak detector 142 and thence along line 110 to the wand signal processor 141. Video peak detector 142 is set to pass video signals which are above a threshold value.

In operation of the components shown in FIG. 4 camera 30 is set up so that the inspection area is in its field of view and it detects signals from any of the wands when they are in the inspection area. Camera 30 is a television-type camera which operates in a conventional manner and is scanned in a raster of lines which form a field. When a signal from a light source on one of the wands is detected this appears as a peak in the video signal output from camera 30. The relative timing between the detected peak in the video signal and the line and field synchronising pulses in camera 30 is an indication of the position of the light source and hence of the wand. More specifically the relationship between the detected peak and the line synchronising pulses gives the position in one orthogonal direction while the relationship between the detected peak and the field synchronising pulses gives the position of the wand in a second orthogonal direction. Thus information relating to the position of a wand as defined by two orthogonal co-ordinates, which may be termed the x and y co-ordinates, is available.

The video signal from camera 30 is passed through video peak detector 142 which is set to eliminate all video signals below a threshold. The signals from the wands are arranged to be above this threshold so that the video signal from peak detector 142 which is passed to the wand signal processors carries information signals derived from the wands and much of the other video information picked up in camera 30 is eliminated since extraneous video information is not required for the purposes of control means 5. However if a monitor screen is provided, to assist for example in aligning camera 30, the signal for such monitor is taken directly from camera 30.

Information as to the positions of all of the wands is received in the wand signal processor 141 is received as a video signal along the single line 110 and in order that the several wands may be individually identified, or for that matter to enable the signal from a single wand to be distinguished from other light sources, the light sources on the wands are individually modulated. The modulation may be amplitude modulation which is synchronised with the line or field scanning rate of camera 30. In the case of cameras employing vidicon or similar light-sensitive devices the lag in response necessitates a low modulation rate based on a field or a number of fields. The signals received in wand signal processor 141 are synchronously demodulated and separated to individual output lines 111 from processor 141 which are used in other parts of the control means 5 as will be more fully described with reference to FIG. 5. Thus where four wands are provided as shown in FIG. 4, the wand signal processor has four output leads each dedicated to one of the wands and along each of which there is provided a corresponding strobe signal containing position information relative to that wand when related to the output of the synchronizing pulse generator.

Figure 5:
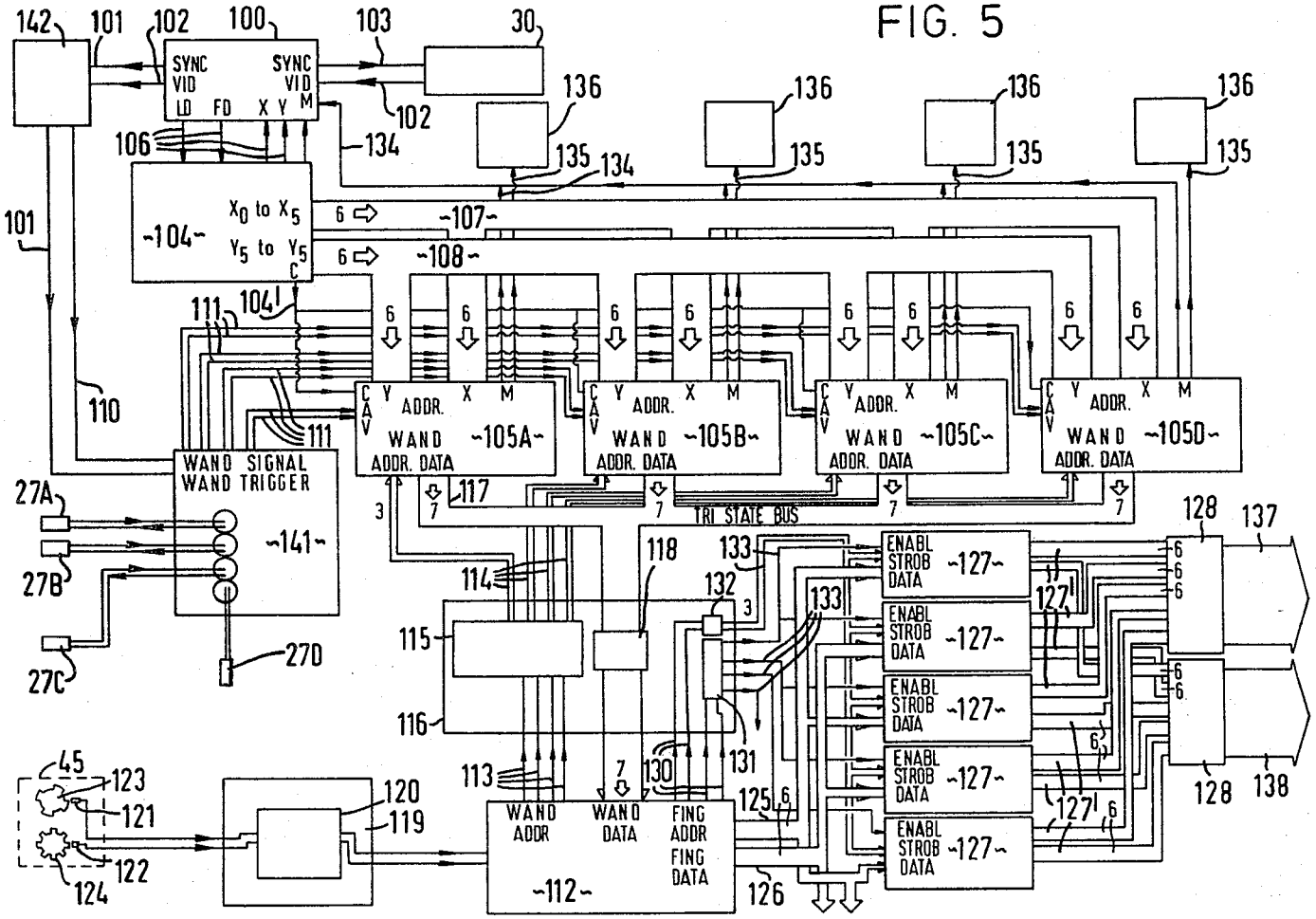
FIG. 5 is a block circuit diagram of a preferred form of the complete control means and associated elements forming part of the potato sorter shown in FIG. 1.

FIG. 5 illustrates in detail an arrangement of the control means 5 in which a micro-computer is used. In addition to showing the complete control means there is also shown in FIG. 5 certain of the peripheral items associated with control means 5. These peripheral items are the camera 30, four wands 27*a*, 27*b*, 27*c* and 27*d* and conveyor sensor means 45. The conveyor sensor means 45 provides information as to the movement of the roller table conveyor 13 of FIG. 1 to the control means 5. As has previously been described with reference to FIG. 4 camera 30 is supplied with synchronising signals from synchronising generator 100, and the camera 30 supplies video signals along line 102 to video peak detector 142 by way of sync generator 100. In FIG. 5 the line 102 is shown passing to video peak detector 142 by way of sync generator 100, whereas in FIG. 4 the line 102 passes direct to detector 142. This merely shows a convenient connection in practice. Similarly the line 101 is shown in FIG. 5 as passing to processors 141 by way of video peak detector 142. Detector 142 feeds wand signal processor 141 (along line 110) with a video signal in the form of video peaks. The video signal on line 110 is essentially a timing signal which is related to the synchronising signals obtained from generator 100 along line 101 to derive the x and y coordinates of the wands. Operation of the switches at the tips of the wands, as by using the wands to touch selected articles, is used directly in the output from wand signal processor 141 to provide wand trigger signals from processor 141 along certain of the lines 111 the purpose of which will be described more fully below.

Control means 5 has a master address generator 104 which generates x and y addresses for controlling feeding of information to four probe registers 105*a* to 105*d*. Master address generator 104 is linked to synchronising generator 100 by five lines 106 which respectively carry line drive and field drive signals and feed x-y display information to generator 100. The x-y information can conveniently be used on a monitor screen to provide guide lines for aligning the camera over the inspection area. Master address generator 104 is linked to each of the wand registers 105*a* to 105*d* by a clock pulse line 104' and by two 6-line buses 107 and 108 which feed the x-y addresses to the registers.

The video signals provided to wand signal processor 141 are demodulated therein and processor 141 provides individual output signals relating to each wand in the form of probe video signals along lines 111 to the respective probe registers 105*a* to 105*d*. Additionally further lines 111 carry the trigger signals to the corresponding wand registers.

The control means of FIG. 5 includes a micro computer 112 which interogates the wand registers 105*a* to 105*d* along wand address lines 113 and 114 by way of a control decode circuit 115 housed in a wand buffer assembly 116. Information read from the wand registers 105*a* to 105*d* is fed to the micro computer along a tri state bus 117 by way of a CMOS-TTL converter 118 situated in the wand buffer assembly 116.

The micro computer 112 also receives information as to the position and movement of the roller table conveyor 13 by way of a machine interface assembly 119 including opto-couplers 120. The table movement information is derived from the roller table position sensing unit 45 which comprises two sensors 121 and 122 which operate respectively from two toothed wheels 123 and 124 rotated on a common shaft driving the roller table conveyor. The toothed wheel 123 has four teeth and the toothed wheel 124 has sixteen teeth. The wheel 123 indicates the position of each roller along the inspection area, and the toothed wheel 124 gives a fine determination of where produce is in the inspection area. The sensors 121 and 122 generate pulses in response to movement of the teeth of the wheels 123 and 124.

Figure 6:
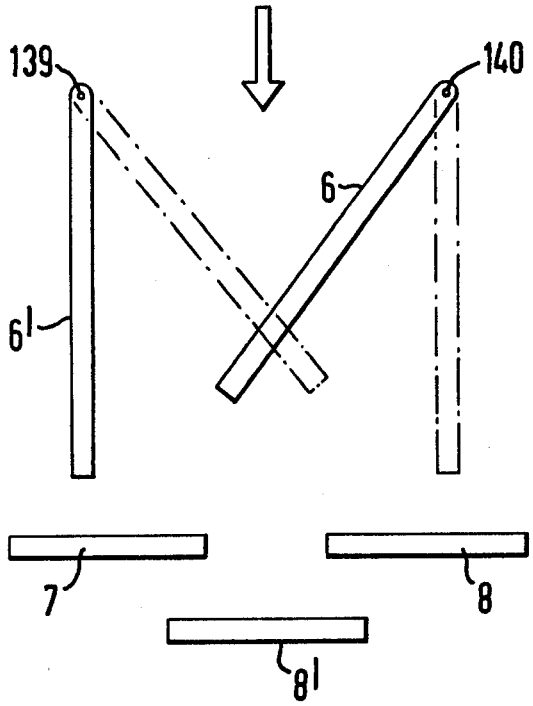
FIG. 6 is a diagrammatic representation of deflector means for use with the control means shown in FIG. 5.

The output of information concerning selected and non-selected articles is fed from the micro computer 112 along data buses 125 and 126 to a series of finger latches 127 which determine whether required fingers are in a deflect or non-deflect position. The outpus 127' of the latches are then grouped in two groups in finger buffer circuits 128 and 129 before being fed to two banks of fingers which are shown in FIG. 6 and will be described hereinafter. The outputs from the finger buffers 128 and 129 are fed to actuate the solenoids of the required fingers so as to achieve three way selection between three output conduits or receptacles. The control of routing of information from the micro computer 112 to the latches 127 is controlled by decoding signals fed from the micro computer 112 along lines 130 to a decode finger address unit 131 and a strobe generator 132 in the probe buffer assembly 116. Outputs from these units are fed along lines 133 to the latches 127 to control cycling of the output from the micro computer 112 along the buses 125 and 126 to the required latch addresses.

Two further outputs from each of the wand registers 105*a* to 105*d* are made along a bus 134 to the sync generator 100 and along lines 135 to a set of four audio markers 136. The purpose of these outputs from the wand registers is to alert the operator to a completed input of information which has been initiated by actuating the switch on the wand. The indication can be made by a visual signal along the bus 134 which produces an indication on a monitor screen (not shown), and by an audio signal which produces a bleep at the audio markers 136.

It is possible by extending the number of address latches 127 to add further wands each of which may have a different operator. Any wand may be used to indicate the selected or rejected item.

Referring now to FIG. 6 there will be described the arrangement of two banks of fingers 6 and 6' which are fed at two output groups of 26 lines each indicated at 137 and 138 in FIG. 5. The fingers 6 and 6' are pivotable about pivots 139 and 140 respectively and are movable between dotted line positions and full line positions in the figure by pneumatic drive units not shown. Three output conveyor belts 7, 8 and 8' are positioned with the belts 7 and 8 on either side of the assembly with a gap between the two belts, and with the third belt 8' positioned centrally below the said gap. Of the various permutations of the two fingers 6 and 6' the combination with both fingers in the central position is a non-effective position and is not available under the direction of the micro computer 112. With both the fingers 6 and 6' in the vertical positions, the articles to be sorted are allowed to fall freely between the conveyor belts 7 and 8 onto the central conveyor belt 8'. With the finger 6 in the full line position and the finger 6' in the full line position, the articles to be sorted are directed by the finger 6' onto the conveyor belt 7. With the fingers 6' in the dotted position and the fingers 6 in the dotted line position, the articles to be sorted are directed onto the conveyor belt 8. Thus by operating permitted combinations of the two finger banks, a three state selection can be made from amongst the articles being sorted.

Referring now again to FIG. 5 there will be described the general operation of the control means shown. The co-ordinates of the wand positions are obtained as previously described from counters synchronized to the T.V. camera 30 in the address generator 104 and stored in the individual registers 105*a* to 105*d* for each of the wands 27*a* to 27*d*. When any wand indicates a reject article by actuating its trigger the co-ordinates of the wand are latched into the associated probe register in addition to the setting of a flip-flop in the probe register unit to act as a flag indicating that the selection has been made.

It is convenient in the embodiment shown to use the micro computer 112 which follows a program of instructions stored in a memory to examine regularly the probe flags and, when one is found "set", to transfer the contents of that wand register to the micro computer memory, and then to reset the flag. This computer 112 also receives pulses from the roller table sensors 121 and 122 and is able in addition to send information to the further sets of latches 127 which drive the selection mechanism consisting of the two banks of fingers fed from the outputs 137 and 138.

The stored wand information is updated each time a pulse is received from the roller table sensors 121 and 122, so that as the articles progress those which have been selected are tracked by the computer 112 which may then generate signals to operate the selection fingers at the appropriate time. The micro computer 112 has three main tasks, namely the repeated monitoring of the wand flags, responding to the roller table sensors, and driving the finger control or selection circuits.

In the foregoing description reference has been made to a number of preferred forms or features of the invention for example a roller table form of conveying means and an electronic control means for actuating a deflector means after a delay appropriate to the position of the selected articles at the time of selection. However it is to be appreciated that a wide variety of forms of conveying means and control means may be adopted within the scope of the invention. For example the conveying means may comprise a plain conveyor belt or may comprise means for presenting discontinuously a series of batches of articles to be sorted into the inspection area, and the articles may remain stationary in the inspection area for an interval of time. In these or other forms of the invention the separating means may include means for identifying a selected article by tagging or labelling the article after selection, for example by applying a dye or other colouring or identifying material to the article selected. These variations, and the embodiments described hereinbefore, may be combined in various combinations all falling within the scope of the invention.

It is to be appreciated that the invention is not limited to arrangements in which selection of an object by a selection means necessarily results in that particular object being physically deflected. Although such an arrangement may conveniently be used, the inverse arrangement may be equally suitable, that is to say that a main throughput of articles may be deflected (for example by falling on to inclined fingers in a finger bank) and those articles specifically selected by a selection means may be allowed to fall through the finger bank undeflected, by the step of withdrawing appropriate fingers from their deflecting positions in the finger bank.

As has been mentioned, it can be arranged for two wands to be available for operation by a single operator using, for example one wand in each hand. Such an arrangement may be provided merely to allow convenience and speed of operation, but in some arrangements the two wands can be arranged to identify selected objects differently and to produce different effects upon objects when the objects reach the deflector means. For example where a three-choice deflection is available as in the embodiment of FIG. 6, one hand-held wand may be arranged to select objects to be deflected to the left and one to select objects to be deflected to the right. In the absence of the selection by either wand, the objects may be left free to fall to the centre conveyor belt. This allows for example sorting of objects into three grades such as "perfects", "seconds" and "rejects".

In a modification of the main embodiment shown in the Figures, the wand 27 may be simplified by replacing the light source 29 by a reflector of the kind used in reflectors for motor vehicles, or "cats eyes" for road markings. Alternatively the light source 29 may be replaced by a simple painted region at the tip of the wand, for example a disc painted with fluorescent paint or with white or brightly coloured paint. In such arrangements care must be taken that the lighting arrangements and background are appropriate to allow the painted region to be easily tracked by the camera. The switch 28 may be retained and operate as before.

What is claimed is:

1. Article sorting apparatus comprising conveying means for conveying articles to be sorted through an inspection area, television camera means for viewing the inspection area, selection means for selecting an article from a plurality of articles present in the inspection area, the selection means including an indicator member manually moveable within the inspection area by an operator viewing the articles in the inspection area for indicating a selected article, and emitter means mounted on the indicator member and moveable with the indicator member within the inspection area to allow the operator to position the emitter means in the direct vicinity of a selected article in the inspection area, the television camera means being arranged to view the inspection area and the emitter means in the inspection area, and to generate signals representing the location of the emitter means in the field of view of the television camera means, the emitter means being adapted to produce an output of electromagnetic radiation to which the television camera means is sensitive relative to the background of the inspection area, separating means for selectively separating articles, and control means for actuating the separating means in dependence upon signals generated by the camera means to effect selective separation of articles in response to article selection by an operator utilising the selection means in the inspection area.

2. Apparatus as claimed in claim 1 in which the separating means comprises deflector means for selectively deflecting articles to achieve the required separation.

3. Apparatus as claimed in claim 2 in which the control means is arranged to actuate the deflector means in dependence upon first and second coordinate signals representative of first and second orthogonal coordinates of locations within the inspection area.

4. Apparatus as claimed in claim 3 in which the first coordinate is in a direction across the path of the conveyor means at the inspection area and the second coordinate is in a direction along the path of travel of the conveyor means at the inspection area.

5. Apparatus as claimed in claim 3 in which the deflector means comprises an array of deflector devices arranged across the path of the conveyor means downstream of the inspection area, and drive means for driving selected deflector devices, the selection of deflector devices actuated being controlled in dependence upon the said first coordinate signals and the timing of operation of the deflector devices being controlled in dependence upon the said second coordinate signals.

6. Apparatus as claimed in claim 2 in which the deflector means are situated downstream of the inspection area relative to the movement of the conveyor means, and in which there is provided conveyor sensor means for producing and feeding to the control means signals dependent upon the speed of the conveyor means, the control means being arranged to control actuation of the deflector means at times related to the transient positions of selected articles at the time of selection and to the speed of movement of the articles from the inspection area to the deflector means.

7. Apparatus as claimed in claim 6 in which the conveyor sensor means includes at least one optical sensor arranged to detect rotation of a sprocket wheel driving the conveyor means.

8. Apparatus as claimed in claim 2 in which the deflector means comprises fingers for deflecting articles falling from the conveyor means, the fingers being actuable between two or more positions so as to direct the falling articles in different directions.

9. Apparatus as claimed in claim 1 in which the emitter means provides an output and the camera means responds to the said output throughout the time that the emitter means is in the field of view of the camera means and in which the selection means includes switch means for providing a trigger signal fed to the control means when the location being indicated by the indicator means is the location of the selected article.

10. Apparatus as claimed in claim 9 in which the indicator member incorporates the said switch means as a part thereof.

11. Apparatus as claimed in claim 10 in which the switch means comprises a switch responsive to pressure or touch of the indicator member on a selected article in the inspection area.

12. Apparatus as claimed in claim 1 in which the indicator member comprises a wand, probe or pointer-like device which is hand-held.

13. Apparatus as claimed in claim 12 in which the switch means is incorporated in the said wand at the tip thereof.

14. Apparatus as claimed in claim 1 in which the emitter means comprises a light source or reflector.

15. Apparatus as claimed in claim 1 in which the camera means has a cyclic scanning arrangement whereby the instant of detection of an indication signal relative to a scanning cycle is a measure of the position of the emitter means in the field of view of the camera means.

16. Apparatus as claimed in claim 15 in which the camera means comprises a television-type camera having a scanning arrangement of field and line scanning motions so that the position of the emitter means along one axis is indicated by the instant in time in a line scan period at which the signal is detected and the position of the emitter means along an axis orthogonal to the said axis is indicated by the time in a field scan cycle of the line in which signals therefrom are detected.

17. Apparatus as claimed in claim 15 in which the output of the camera means consists of a video signal representing a line and field scan of the image of the selection area.

18. Apparatus as claimed in claim 17 in which a monitor screen is provided to display the field of view of the camera means.

19. Apparatus as claimed in claim 1 in which a plurality of selection means are provided, and each selection means emits individually modulated radiation.

20. Article sorting apparatus comprising conveying means for conveying articles to be sorted through an inspection area, television camera means for viewing the inspection area, selection means for selecting an article from a plurality of articles present in the inspection area, the selection means including an indicator member manually moveable within the inspection area by an operator viewing the articles in the inspection area for indicating a selected article, and emitter means mounted on the indicator member and moveable with the indicator member within the inspection area to allow the operator to position the emitter means in the direct vicinity of a selected article in the inspection area, the television camera means being arranged to view the inspection area and the emitter means in the inspection area, and to generate signals representing the location of the emitter means in the field of view of the television camera means, the emitter means being adapted to produce an output of electromagnetic radiation to which the television camera means is sensitive relative to the background of the inspection area, separating means for selectively separating articles, said separating means comprising deflector means positioned downstream of the inspection area for selectively deflecting articles to achieve the required separation, and control means for actuating the separating means in dependence upon signals generated by the camera means to effect selective separation of articles in response to article selection by an operator utilising the selection means in the inspection area, said selection means comprising a hand-held indicator member on which the emitter means is mounted for indicating a location in the field of view of the camera means by moving the emitter means to the region of that location and the emitter means output consisting of light in the visible range generated by the emitter means indicating the position of the location indicated by the indicator member.

21. Apparatus as claimed in claim 20 in which the emitter means provides an output and the camera means responds to the said output throughout the time that the emitter means is in the field of view of the camera means and in which the selection means includes switch means for providing a trigger signal fed to the control means when the location being indicated by the indicator means is the location of a selected article, said switch means comprising a switch responsive to pressure or touch of the indicator member on a selected article in the inspection area, and said indicator member comprising a hand-held pointer-like device with the switch means incorporated at the tip thereof.

22. A method of sorting articles comprising the steps of conveying articles to be sorted through an inspection area, viewing the inspection area with a television camera means, selecting an article from a plurality of articles which are present simultaneously in the inspection area, indicating the position of a selected article in the inspection area by moving within the inspection area an emitter means mounted on an indicator member to bring the emitter means in the direct vicinity of the selected article in the inspection area, emitting from the emitter means electromagnetic radiation to which the television camera means is sensitive relative to the background of the inspection area, generating from the television camera means signals representing information as to the, location of the emitter means in the field of view of the television camera and selectively operating on said articles in dependence upon said signals generated by the television camera means.

23. The method as claimed in claim 22 in which the step of selectively operating on said articles comprises deflecting selected articles.

24. The method as claimed in claim 22 in which the step of generating from the camera means signals representing position information comprises generating first and second coordinate signals representative of first and second orthogonal coordinates of a location in the inspection area, the orthogonal coordinates being arranged with the first coordinate in a direction across the path of conveying of the articles at the inspection area and with the second coordinate in a direction aligned along the path of conveying of the articles at the inspection area.

25. The method as claimed in claim 24 in which the step of selectively operating on said articles comprising actuating selected deflector devices of an array of deflector devices positioned across the path of conveying of the articles downstream of the inspection area, the selection of deflector devices actuated being controlled in dependence upon the first coordinate signals and the timing of operation of the deflector device being controlled in dependence upon the second coordinate signals.

26. The method as claimed in claim 22 and including the step of generating sensing signals dependent upon the speed of conveying of the articles and utilising said sensing signals to time the deflection of selected articles at positions downstream of the inspection area.

27. The method as claimed in claim 22 including the step of emitting the said emitted signal by generating or by reflecting light.

* * * * *